United States Patent [19]

Mark et al.

[11] Patent Number: 4,721,834

[45] Date of Patent: Jan. 26, 1988

[54] LEVER CONTROL SYSTEM

[75] Inventors: Charles H. Mark, Lafayette; Ellis P. Lipp, Charlottesville, both of Ind.

[73] Assignee: Emhart Industries, Inc., Indianapolis, Ind.

[21] Appl. No.: 857,496

[22] Filed: Apr. 30, 1986

[51] Int. Cl.[4] ..... H01H 21/00; G05G 13/00

[52] U.S. Cl. ..... 200/6 A; 74/471 XY

[58] Field of Search ..... 33/14, 122, 123, 124, 33/1 MP; 74/471 XY, 471 R, 479, 519; 340/365 R, 709, 706; 273/148 B; 200/6 A

[56] References Cited

U.S. PATENT DOCUMENTS

| | | | |
|---|---|---|---|
| 2,455,963 | 12/1948 | Wheeler | 74/471 XY |
| 3,369,427 | 2/1968 | Brighton et al. | 74/471 |
| 3,394,611 | 7/1968 | Beurrier | 74/471 XY |
| 3,918,021 | 11/1975 | Nishioka et al. | 74/471 XY X |
| 4,489,304 | 12/1984 | Hayes | 74/471 XY |
| 4,587,510 | 5/1986 | Kim | 74/471 XY |
| 4,670,743 | 6/1987 | Zemke | 340/709 |

FOREIGN PATENT DOCUMENTS

| | | | |
|---|---|---|---|
| 2308226 | 11/1976 | France | 74/471 XY |
| 627545 | 11/1945 | United Kingdom | 74/471 XY |

OTHER PUBLICATIONS

IBM Technical Bulletin, vol. 23, #8, Jan. 1981, J. E. Fox.

*Primary Examiner*—Randolph A. Reese
*Assistant Examiner*—Anthony Knight
*Attorney, Agent, or Firm*—Carl A. Forest

[57] ABSTRACT

A lever is carried in a holder that permits the lever to be pivoted in a complete circle to permit up/down and left/right movement or any position in between. The lever engages a carriage which carries electrical contacts. Movement of the carriage by the lever causes the electrical contacts to move to be able to engage selective electrical paths.

2 Claims, 8 Drawing Figures

LEVER CONTROL SYSTEM

BACKGROUND OF THE INVENTION

The present invention relates to a control system and more particularly to a control system that is especially useful for completing electrical circuits to motors for movement of outside rear view mirrors on automobiles.

Present day rear view mirror systems for automobiles operate from motors which drive the mirrors to a desired position. Under such a system, it is desirable that not only should the mirrors be independently operable, but the motors for each mirror should be operable at the same time. The present control system very admirably provides a means for accomplishing this.

SUMMARY OF THE INVENTION

In accordance with the present invention, there is provided a lever control system which permits electrical contacts to be moved in positions through a complete circle to permit electrical circuits to be completed to perform the desired functions. The control system comprises a holder, slot means in the holder, an axially spring biased lever pivotally carried in the slot means, the slot means constructed and arranged to permit the lever to be moved in a complete circle to provide up/-down, sideways, and movement in between, a carriage coupled to the lever for movement in response to movement of the lever; and electrical contacts carried on the carriage.

DESCRIPTION OF THE DRAWINGS

FIGS. 3A–5A are views taken along the lines 3A—3A through 5A—5A of FIGS. 3–5 respectively.

DETAILED DESCRIPTION OF THE INVENTION

Figure 1:
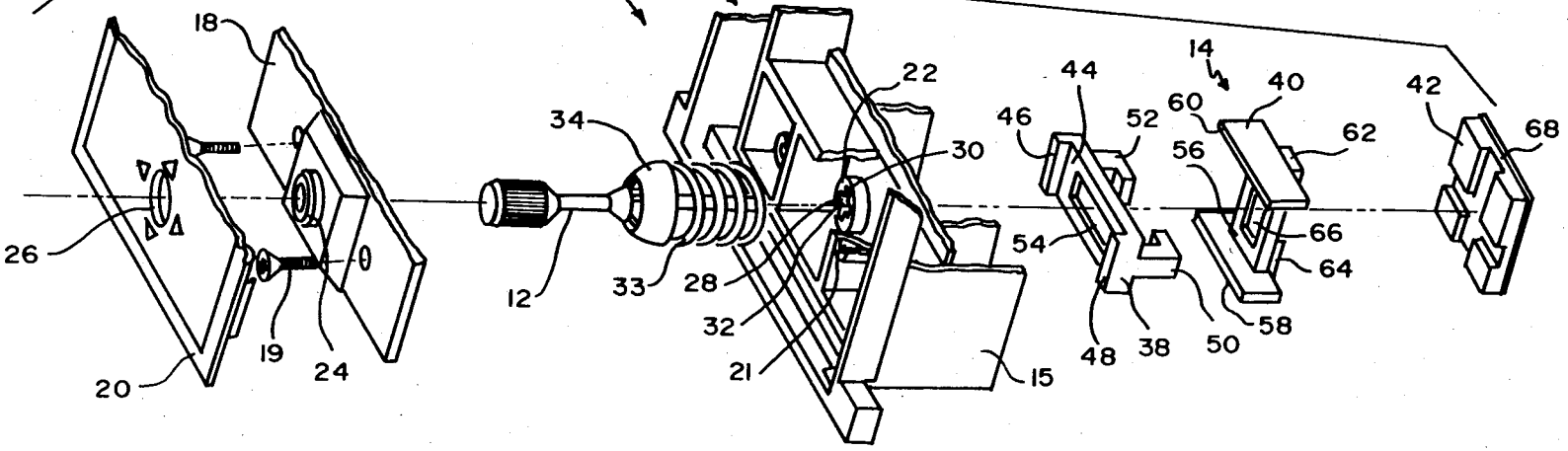
FIG. 1 is an exploded view of a control system employing the features of the invention.

Referring now to the drawings, there is shown a control system 10 embodying the features of the invention. Control system 10, in general, includes a lever 12 and carriage 14 that are carried in a housing 16, only a portion of which is shown. The housing includes frame 15, a front plate 18, and a casing 20 which is clamped over the front plate. Front plate 18 is held to the frame 15 through screws 19 which engage internally threaded extensions 21. Lever 12 is pivotally mounted within the housing through a holder 22 and extends outside the housing through apertures 24 and 26. Referring to FIGS. 1 and 3–5, holder 22 is integral with a wall 23 which divides frame 15 into back to back compartments 25 and 27. The holder includes intersecting slots 28 and 30 which provide enough space at their intersection 32 to permit the lever to be pivoted through a full circle. The lever is centered within holder 22 through a coil spring 33 that is held at one end by a cup 34 and at the other end by holder 22.

Figure 2:
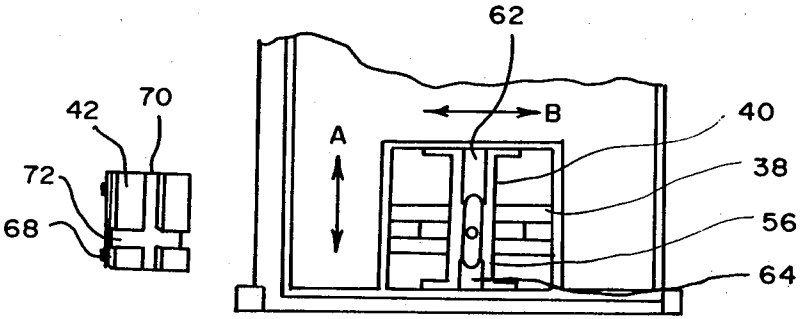
FIG. 2 is an exploded view of a portion of the control system showing a carriage which carries electrical contacts for the control system.

Carriage 15 includes a pair of slides 38 and 40 and a platform 42 that are all carried in compartment 15. Slider 38 includes a base member 44 having legs 46 and 48 extending therefrom which slide along wall 23 which separates compartments 25 and 27. Two rails 50 and 52 extend from the base. There is also an elongated opening 54 in the base into platform 42 into which lever 12 is engaged. Slider 40 includes a base 56 having legs 58 and 60 which slide along wall 23. Two rails 62 and 64 extend from the base into platform 42 and there is an elongated opening 66 into which the lever 12 is engaged. Referring to FIG. 2, slider 38 moves back and forth in the direction of arrow A while slider 40 moves back and forth above slider 38 in the direction of arrow B.

Referring to FIGS. 2 and 3–5, platform 42 includes a base 68 having intersecting channels 70 and 72 therein. Since the rails 50, 52, and 62, 64 engage platform 42, the platform moves when sliders 38 and 40 move. Channel 70 engages rails 62 and 64 while channel 72 engages rails 50 and 52. Electrical contact bars 74 and 76 are carried by the platform, each of the bars including electrical contacts 78, 80, 82, and 84. The electrical contacts engage a printed circuit board 90 carried on a base 92.

The housing 16, the sliders 38 and 40, the platform 42, and holder 22 are fabricated of suitable plastic. The electrical contact bars 74 and 76§ with their electrical contacts 78, 80, 82 and 84 are fabricated of a good electrically conductive material such as copper. Lever 12 and spring 32 are fabricated of a suitable metal such as steel.

Figure 3A:
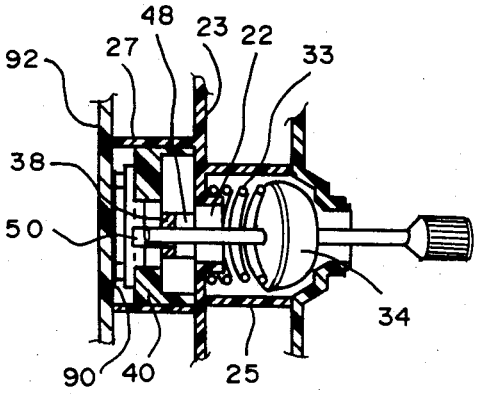
Figure 3:
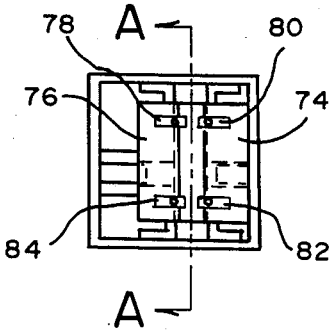
FIGS. 3–5 are partial cross sections showing different operating modes of the operating lever of the control system.
Figure 4A:
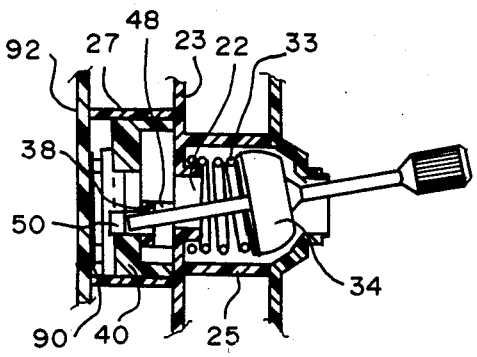
Figure 4:
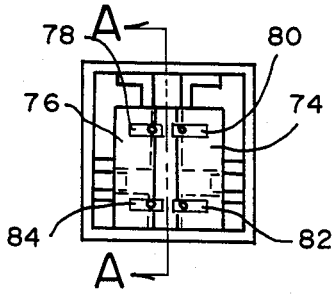
Figure 5A:
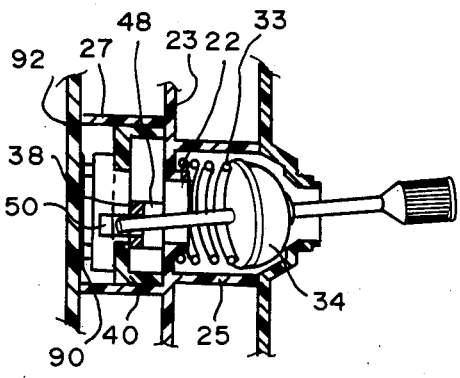
Figure 5:
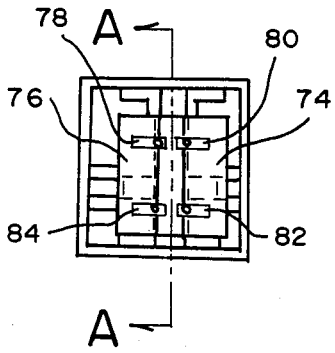

The operation of the control switch can now be described with reference to FIGS. 3–5A. In FIGS. 3 and 3A, lever 12 has been pivoted into the paper to move slider 38 and platform 42 to the right. In FIGS. 4 and 4A lever 12 has been pivoted up to move slider 40 down. In FIGS. 5 and 5A, lever 12 has been pivoted into the paper and upward to move both sliders 38 and 40 down and to the right.

What is claimed is:

1. A joystick operated system comprising (a) a holder, (b) a spring biased lever carried in said holder, (c) slot means in said holder permitting said lever to be moved in a complete circle, sideways, up and down, (d) a carriage coupled to said lever to be responsive to movement of said lever, said carriage including overlying, intersecting sliders having openings to receive a distal end of said lever, rails carried by said intersecting sliders and a movable platform having intersection channels mating said rails, (e) electrical contacts carried by said platform of said carriage, and (f) said electrical contacts engaging associated fixed contacts adjacent to said carriage.

2. A control system according to claim 1 wherein said slot means includes intersection slots having sufficient space at their intersection to permit said lever to rotate through a complete circle.

* * * * *